US007005080B2

(12) United States Patent
Holland et al.

(10) Patent No.: US 7,005,080 B2
(45) Date of Patent: Feb. 28, 2006

(54) NONABRASIVE MEDIA WITH ACCELLERATED CHEMISTRY

(75) Inventors: Jerry Holland, Bryan, TX (US); Mark Michaud, Austin, TX (US); Mike Solarno, Southington, CT (US); Gary Sroka, Missouri City, TX (US); Lane Winkelmann, New Ulm, TX (US)

(73) Assignee: REM Technologies, Inc., Southington, CT (US)

( * ) Notice: Subject to any disclaimer, the term of this patent is extended or adjusted under 35 U.S.C. 154(b) by 119 days.

(21) Appl. No.: 10/684,073

(22) Filed: Oct. 13, 2003

(65) Prior Publication Data

US 2004/0074871 A1 Apr. 22, 2004

Related U.S. Application Data

(63) Continuation of application No. 09/758,067, filed on Jan. 10, 2001, now abandoned.

(51) Int. Cl.

| | |
|---|---|
| ***B44C 1/22*** | (2006.01) |
| ***C03C 15/00*** | (2006.01) |
| ***C03C 25/68*** | (2006.01) |
| ***C23F 1/00*** | (2006.01) |

(52) U.S. Cl. ..... 216/53; 216/87

(58) Field of Classification Search ..... 216/38, 216/52, 53; 451/32, 33, 34, 35

See application file for complete search history.

(56) References Cited

U.S. PATENT DOCUMENTS

| | | | | | |
|---|---|---|---|---|---|
| 4,307,544 | A | * | 12/1981 | Balz | 451/32 |
| 4,491,500 | A | * | 1/1985 | Michaud et al. | 216/87 |
| 4,705,594 | A | * | 11/1987 | Zobbi et al. | 216/90 |
| 4,818,333 | A | * | 4/1989 | Michaud | 216/90 |

* cited by examiner

*Primary Examiner*—Parviz Hassanzadeh
*Assistant Examiner*—Roberts Culbert
(74) *Attorney, Agent, or Firm*—Howrey, LLP

(57) ABSTRACT

The invention is an improvement in the metal finishing processes disclosed in U.S. Pat. No. 4,818,333. The improvement arises in the use of nonabrasive media, such as stainless steel or plastic, in combination with chemicals that are reactive to the metal surface processed. The invention also includes metal articles finished using this process.

34 Claims, 1 Drawing Sheet

1(a)

1(b)

1(c)

NONABRASIVE MEDIA WITH ACCELLERATED CHEMISTRY

RELATED APPLICATION DATA

This application is a continuation of U.S. application Ser. No. 09/758,067, filed Jan. 10, 2001 abandoned.

BACKGROUND OF THE INVENTION

This invention refines the surfaces of metal articles for cosmetic purposes and/or for mechanical functioning purposes, so that the surface of those articles is isotropic, superfinished, and of specular brightness. This invention encompasses both a method for refining these surfaces, and the novel articles that result from the practice of that method. The improved surfaces produced by this invention may yield improved performance in the parts processed.

There are a variety of metal articles for which machining/grind lines are a problem. Examples of mechanical parts with critical working surfaces include splines, crankshafts, camshafts, bearings, gears, couplings, and journals. For these parts, poor surface contact performance caused by lines can increase friction, torque, noise, vibration, operating temperature, and impair lubricity, and negatively impact failure in areas of wear, scuffing, plastic deformation, and contact fatigue and/or bending fatigue. For gears or other parts placed in a demanding environment such as the drivetrain of a helicopter or racing car, resistance to these types of failures in effect defines the useful life of the article.

Critical surfaces (including recessed areas) have conventionally been refined through various machine grinding/polishing processes. But those processes have multiple drawbacks. For complex shapes, machine grinding tools are very expensive, require skilled operators, and undergo excessive wear. Metal parts having an HRC of approximately 42 and higher are not well suited for these techniques. Machine grinding often leads to directional grind lines, and can damage the heat treatment of a metal surface, creating potential failure sites. Finally, machine grinding is carried out on a part-by-part basis, and as such, is plagued with problems of repeatability and uniformity.

REM Chemicals, Inc. has developed and described in its patents techniques that refine metal parts, on a mass process basis, to a smooth and shiny surface. Those techniques have been used commercially for many years in which the process objective is directed primarily to the cosmetic appearance of the part rather than to its mechanical performance. To that end, REM's U.S. Pat. No. 4,491,500 discloses an improvement to traditional mass finishing methods, in which certain chemicals are added to a mass finishing device (such as a vibratory bowl or tumbling barrel) in combination with ceramic bodies (called "media") and one or more metal workpieces. The chemicals are mildly reactive to the metal, creating a soft coating (called "blackmode") on the surface, which is removed through vibratory agitation with the media. The resulting surface is smooth and shiny. The media employed in the '500 patent are abrasive—i.e., they are (compared to mildly or non-abrasive media) more rapidly degraded during the finishing process.

REM's U.S. Pat. No. 4,818,333 discloses an improvement to the process of the '500 patent. That patent describes the use with chemicals of ceramic media having a density of at least 2.75 g/cc, and which are comparatively free of abrasive grit, as is commonly found in vibratory finishing media. Suitable media identified in that patent include ceramics of silica and alumina, in combination with other metal oxides.

The claims of that patent characterize that media based upon the percentage of weight loss when employed in a vibratory finishing bowl under certain, specified conditions.

Neither REM patent identifies any improvement in the mechanical performance of articles finished using the disclosed processes. Nevertheless, REM has demonstrated that gears, bearings, and other articles processed in accordance with the '500 and '333 patents can enjoy a significant enhancement in performance. And REM has used the processes of those patents commercially for that purpose. For example, U.S. Pat. No. 5,503,481 describes the use of the '333 patent process to give an isotropic surface on bearings, thereby imparting a greater fatigue life for those parts. However, the media employed in the '500 and '333 patents are not ideally suited for finishing processes aimed at enhanced mechanical performance. The '333 patent media have an average diamond pyramid hardness (DPH) value of at least 890, and therefore impart a mechanical texture to part surfaces that are exposed to it. Though the present invention is still applicable to cosmetic finishing, this invention addresses the problem of media hardness by using media (such as metals and/or plastic) that are softer, yet non-abrasive.

Softer non-abrasive media have been used commercially for the refinement of metal surfaces in the past. The ABRIL process, for example, has employed zinc media, but in combination with an abrasive compound.

REM has, more than a year before the filing of the present application, made commercial use of certain plastic abrasive media in combination with reactive chemicals to finish brass and stainless steel parts. But those processes produced surfaces with an $R_a$ (6–10 microinches) that was insufficient for specular brightness or superfinishing. Through the processes disclosed herein, REM has been able to superfinish metal articles to a superior isotropic surface.

SUMMARY OF THE INVENTION

The invention includes a method that superfinishes metal surfaces to specular brightness and an isotropic finish. That method generally includes the step of placing an article(s) in a vibratory finishing bowl, in combination with a nonabrasive media and a chemical solution capable of reacting with the surface of said metal article to convert it to a softer form. These materials are then agitated for a time sufficient to impart the desired surface to the article. In one embodiment of that invention, the non-abrasive media is a plastic media. In another embodiment, the media is metal. Preferably, the media are not significantly reactive with the chemical solution.

The use of metal or plastic media offers several advantages over the processes disclosed in the '500, 481' and '333 patents. As noted above, those media are softer, and therefore less prone to mechanical texturing of the processed surface. Moreover, plastic and metallic materials are more easily formed (as compared to ceramics) into specific shapes and sizes—which is important in finishing parts of varying shape and dimension. The process of this invention is illustrated in the multiple examples that follow. Those examples illustrate other embodiments of the invention—specifically, the articles processed using the methods disclosed herein.

DEFINITIONS

The following definitions are employed to describe and/or claim the invention:

"$R_a$" (or Arithmetic Mean Roughness) is defined and measured in accordance with ISO standard 4287, which is the same as DIN standard 4768.

$R_{max}$ (or Maximum Roughness Depth), is defined and measured in accordance with DIN standard 4768.

A "superfinished surface" is one that has an $R_a$ of less than or equal to 2.5 microinches.

An "isotropic surface" is one having substantially no orientation to its surface irregularities.

"Media" are solid bodies placed in a vibratory finishing bowl, other than the articles to be finished.

"Specular brightness" is the property of a surface in which you can see a clear reflection of an object.

"Non-abrasive" media are media that, under the intended set of processing conditions, will lose less than 0.1% of their weight per hour, and achieves the defined superfinished surface condition.

DESCRIPTION OF ILLUSTRATIVE EMBODIMENTS

Figure 1:
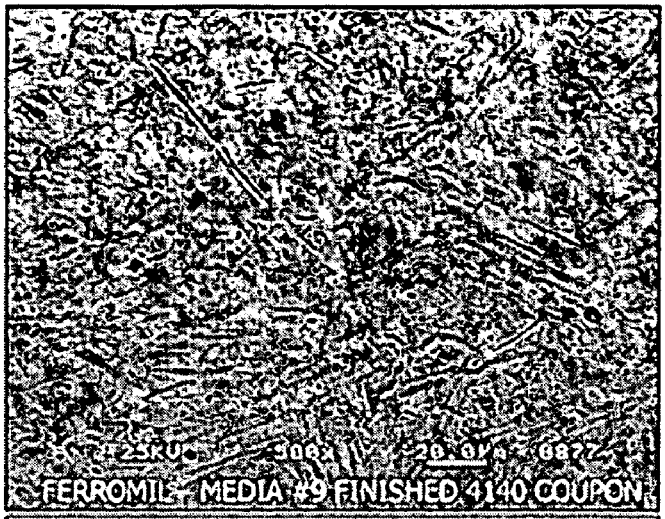
FIG. 1 are SEM images of the surface of a 4140 steel coupon with an HRC of approximately 43–45 finished using REM's '333 patent process (1(*a*)), and the process of the present invention as practiced with plastic media (1(*b*)) and stainless steel media (1(*c*)).
Figure 1:
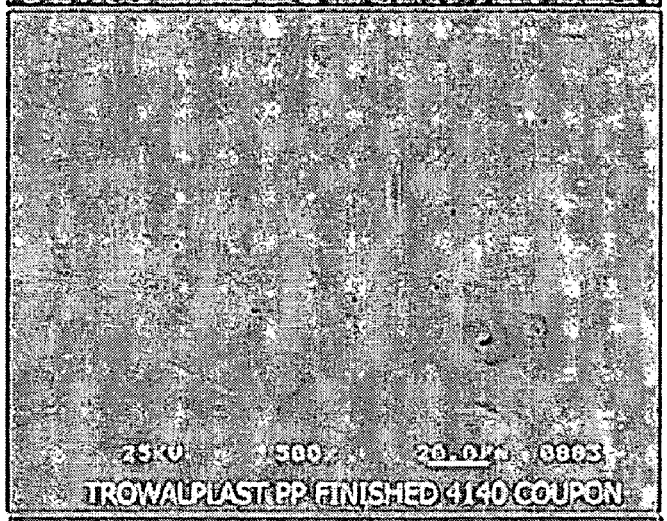
Figure 1:
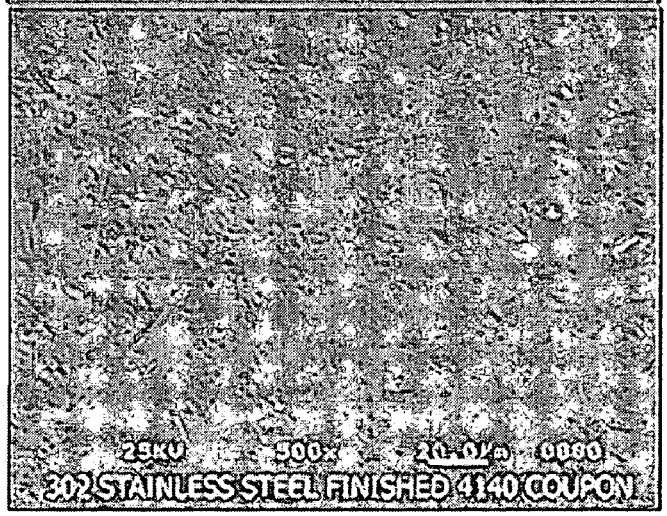

This invention provides a method for producing on metal articles superfinished, isotropic surfaces with specular brightness. The metal articles are machined through conventional methods that are well known in the art. As a typical final fabrication step, the article is superfinished to an isotropic finish with specular brightness. A procedure for doing that is described below:

Finishing Procedure

A superfinished, isotropic surface can be applied to a metal article through a significant and novel modification of the processes disclosed in U.S. Pat. Nos. 4,818,333, 4,491,500, and 5,503,481.

a. The Vibratory Bowl

Isotropic surfaces may be achieved using a conventional vibratory finishing unit, of the sort described in the U.S. Pat. No. 5,503,481, '500 and '333 patents. The unit may be operated at 800–1500 revolutions per minute, at an amplitude of 1 to 8 millimeters. The '333 patent identifies a 2–4 millimeter amplitude as preferred. During operation, the chemical solution may be added on a flow-through basis, such that fresh solution is continuously introduced and used solution is continuously drawn off and discarded. That solution may be introduced at a rate of 0.25–0.4 gallons per hour per cubic foot. Operation of the equipment will generate heat that typically increases the temperature of the vibratory system (media, solution and parts) to about 35 degrees Centigrade over time.

b. The Media

This invention achieves improved metal finishing results (over the methods described in REM's '333, '500 and '481 patents) by employing different media and chemical treatments that are compatible with those media. In one embodiment, the media are composed of a plastic that is non-abrasive under the operating conditions of the vibratory bowl. Those media preferably have a hardness of approximately 57 on the Barcol scale, and are "soft" as compared to the ceramic media disclosed in REM's '333 patent. Under the chemical treatment conditions disclosed below, these soft, plastic media give better surface treatment than has been achieved using the ceramic media of REM's '333 patent. One example of a suitable (and commercially available) plastic media is the TROWALPLAST PP product sold by Walther Trowal, Ltd. That media is composed of 50% (by weight) alumina bonded with an unsaturated polyester resin. It has a density of about 1.8 g/cm$^3$ and a crystal size of less than 0.9 mm.

In another embodiment of this invention, the media are composed of a metal that is inert to the chemical treatment conditions. One such material that is compatible with the chemical treatments disclosed below is AISI grade 302 stainless steel. Those media are available from various suppliers in a variety of shapes and sizes. Abbott Ball is one supplier of such media. When using these media, it may be necessary to employ vibratory bowls having a greater mass carrying capacity.

c. The Chemical Solution

The chemical solutions useful in this invention are described generally in REM's '500 and '333 patents. The chemical solution reacts with the metal of the treated articles, leaving a soft coating of reaction product on the surface ("blackmode"). The reactive chemicals employed in these solutions may include phosphoric acid or phosphates, sulfamic acid, oxalic acid or oxalates, sulfuric acid or sulfates, chromic acid or chromates, bicarbonate, fatty acids or fatty acid salts, or mixtures of these materials. The solution may also contain an activator or accelerator, such as zinc, magnesium, iron phosphates and the like, as well as inorganic or organic oxidizers, such as peroxides, meta-nitrobenzene, chlorate, chlorite, persulfates, nitrate, and nitrite compounds.

A variety of chemical solutions useful in this invention are sold commercially by REM Chemicals, Inc. These solutions include acid/salt components in a weight percent range of approximately 15–45%, promoters in a range of 1% by weight, and oxidizers in a range of 0 to 15% by weight. Specific formulations that may be used in this invention include the following REM products:

1. FERROMIL® FML 575 IFP, an acidic aqueous solution which contains a mixture of inorganic phosphates with a proprietary oxidizer and surfactant.
2. FERROMIL® VII AERO-700, an aqueous organic acid solution with a proprietary surfactant and inhibitor.
3. REM® COPPERMIL 7 an acidic aqueous solution which contains hydrogen peroxide and a proprietary inhibitor.

These formulations are sold as a concentrate, which can be diluted with water to prepare the chemical solution that is introduced to the bowl. Typical dilutions will introduce the concentrate as 5–80% by volume of the solution.

Following this treatment, it is often desirable to introduce a second solution into the vibratory bowl to burnish the metal articles. One suitable burnishing solution for steel is sold by REM Chemicals, Inc. under the label FERROMIL® FBC-218. That solution contains a complex inorganic phosphate and a proprietary surfactant. REM® COPPERMIL CBC-235 burnish is sold by REM Chemicals, Inc. and is suitable for brass. It is an aqueous phosphoric acid based product that also contains proprietary surfactants and inhibitors.

This invention provides an isotropic surface by balancing the rates of blackmode formation and removal. If the blackmode is too hard, then there will not be enough energy to remove it, and effective refinement stops. If the blackmode is too soft, then the process will produce a surface that is textured. Blackmode characteristics are also important to achieving a uniform finish that will leave the parts in tolerance once the process is complete. Provided below are multiple examples of process conditions that achieve that balance.

The following are worked examples of the present invention, as compared to the process disclosed in REM's '333 patent:

EXAMPLE 1

Comparison

An SAE 4140 steel coupon, HRC 43–45, and an adjustable wrench, HRC 42–45, are finished in accordance with the process disclosed in REM's '333 patent.

A ten cubic foot Sweco vibratory bowl is used, at a lead angle of 60 degrees with a vibration amplitude of 4.0 mm. The media are FERROMIL® Media #9 (available through REM), the composition of which are disclosed as "Media C" in REM's '333 patent. Those media are used as ¾ inch cones. The chemical solution is FERROMIL® FML-575 IFP, described above, which is maintained at 12.5% by volume for 6.75 hours at a flow rate of 3.75 gallons/hour. The parts are subsequently burnished through the introduction of FERROMIL® FBC-218 solution (described above) maintained at 1% by volume, and flowed at 21 gallons/hour for a 4-hour period. The bowl is loaded with 20 square feet of 4140 steel bar HRC 43–45.

The steel coupon has a starting $R_a$ of 23.4 (microinches as all $R_a$ and $R_{max}$ values stated herein) and a starting $R_{max}$ of 200, as measured using a profilometer. After processing, the coupon has an $R_a$ of 1.46 and $R_{max}$ of 13.7, and a medium specular bright appearance. FIG. 1(*a*) shows that FERROMIL® Media #9 results in a highly textured final surface finish on a 4140 steel coupon with a 43–45 HRC.

The adjustable wrench does not appear fully finished having residual blackmode in and around the lettering, along the shoulder area of the handle, and running along the length of the handle. The roughness measurements were made using a Model MP4i Perthometer manufactured by Mahr, along a trace length of 0.06 in. with a Gaussian filter.

EXAMPLE 2

Finishing with Plastic Media

An SAE 4140, 43–45 HRC, steel coupon and an adjustable wrench, 42–45 HRC, are finished in accordance with one embodiment of this invention. A ten cubic foot Sweco vibratory bowl is used, at a lead angle of 60 degrees with a vibration amplitude of 4.0 mm. The media are Walther Trowal TROWALPLAST PP media, which are described above. Those media are used as 19-mm cones. The chemical solution is FERROMIL® FML-575 IFP, described above, which is maintained at 12.5% by volume for 6.75 hours at a flow rate of 3.75 gallons/hour. The parts are subsequently burnished through the introduction of FERROMIL® FBC-218 solution (described above) maintained at 1% by volume, and flowed at 21 gallons/hour for a 4-hour period. The bowl is loaded with 20 square feet of 4140 steel bar HRC 43–45.

The steel coupon has a starting $R_a$ of 20.3 and a starting $R_{max}$ of 230, as measured using a profilometer. After processing, the coupon has an $R_a$ of 0.49 and $R_{max}$ of 7.32. In final appearance, the coupon is of superior specular brightness, i.e., the surface is as reflective as a mirror. FIG. 1(*b*) shows that TROWALPLAST PP media results in a significantly superior surface finish on the 4140 steel coupon with a 43–45 HRC in comparison with FIG. 1(*a*) produced using the FERROMIL® Media-#9.

The adjustable wrench also had a finish better than what was obtained in example 1. There is no residual blackmode buildup on the shoulder of the handle or in the raised lettering. The finish is superior to that obtained using the '333 patent procedure (example 1).

EXAMPLE 3

Finishing with Stainless Steel Media

An 8620 case hardened coupon and gear are finished in accordance with another embodiment of this invention.

A four cubic foot Vibra Finish of Canada vibratory bowl is used, at a lead angle of 60 degrees with a vibrational amplitude of 4.5 mm. The media are 302 stainless steel, introduced as a mixture of 20 w/w % 3/32"×3/8" pins; 40 w/w % 1/8" diagonals; 40 w/w % 3/16" ballcones. The chemical solution is FERROMIL® VII AERO-700 described above, which is maintained at 75% by volume for 8.0 hours at a flow rate of 2.5 gallons/hour. The parts are subsequently burnished through the introduction of FERROMIL® FBC-218 solution (described above) maintained at 1% by volume, and flowed at 20 gallons/hour for a 4-hour period. For this example, the bowl is loaded with 20 square feet of 8620 steel bar HRC 58–60. The gear (Webster 8620 carburized steel, 20-tooth gear, 8-diametral pitch and 25° pressure angle) has a fillet radius of approximately 0.0469 inches.

The steel coupon has a starting $R_a$ of 29.8 and a starting $R_{max}$ of 262, as measured using a profilometer. After processing, the coupons have an $R_a$ of 1.95 and $R_{max}$ of 21.4. In final appearance, the coupon is of medium specular brightness in appearance.

The side surface of the gear tooth had a starting $R_a$ of 41.0 and starting $R_{max}$ of 202. After processing, that surface had an $R_a$ of 1.83 and $R_{max}$ of 18.4. The gear tooth working surface had a starting $R_a$ of 10.6 and starting $R_{max}$ of 94.4. After processing, that surface had an $R_a$ of 3.9 and $R_{max}$ of 31.4. Because this was an off-the-shelf OEM automotive gear, it was not of sufficient quality to produce a superfinish on its working surfaces. However, even the root fillet recesses of the gear showed significant surface finishing. There was no blackmode in the recessed areas. Although parts were slightly discolored after burnishing, they did have a specular appearance.

A SAE 4140 steel coupon and with a 43–45 HRC has a starting $R_a$ of 23.7 and a starting $R_{max}$ of 212, as measured using a profilometer. After processing, the coupon has an $R_a$ of 1.46 and $R_{max}$ of 12.0. FIG. 1(*c*) shows that 302 stainless steel media results in a significantly improved surface finish on the 4140 steel coupon (FERROMIL® VII AERO-700 under similar conditions as above) in comparison with FIG. 1(*a*) produced using the FERROMIL® Media #9. It is not quite as good though as that produced by the TROWALPLAST PP media.

EXAMPLE 4

Finishing a Delicate Brass Part with Plastic Media

A delicate thin walled brass cigarette lighter case is finished in accordance with one embodiment of this invention.

A 0.75 cubic foot Raytech vibratory bowl is used, at 25% power through a variable power rheostat. The media are Walther Trowal TROWALPLAST PP media, which are described above. Those media are used as 19-mm cones. The chemical solution is REM® COPPERMIL 7 described above, which is maintained at 10% by volume for 5 hours at a flow rate of 0.3 gallons/hour. The parts are subsequently burnished through the introduction of REM® COPPERMIL CBC-235 solution (described above) maintained at 1% by volume, and flowed at 3 gallons/hour for a 1 hour period. The bowl is loaded with 1.3 square feet of C36000 brass bar.

The lighter has a starting $R_a$ of 10.7 and a starting $R_{max}$ of 77.6, as measured using a profilometer. After processing, the lighter has an $R_a$ of 1.22 and $R_{max}$ of 13.4. In final appearance, the lighter is of superior specular brightness.

What is claimed is:

1. A method for finishing a metal article, comprising the steps of:

a) placing the metal article in a vibratory finishing apparatus, in combination with:

i. a chemical solution capable of reacting with the surface of the metal article to form a blackmode on the surface of the metal article, and ii. a non-abrasive plastic media; and b) agitating the metal article, the non-abrasive plastic media, and chemical solution in the vibratory finishing apparatus so as to allow the non-abrasive plastic media to remove the blackmode from the surface of the metal article, thereby refining the surface of the metal article, after which the blackmode is immediately re-formed by the reaction between the metal article and the chemical solution for further refining by the non-abrasive plastic media, until the metal article achieves a superfinished surface.

2. The method of claim 1, wherein the vibratory finishing apparatus is operated at 800–1500 revolutions per minute at an amplitude of 1 to 8 millimeters.

3. The method of claim 1, wherein the chemical solution is added to the vibratory finishing apparatus at a rate of 0.25–0.4 gallons per hour per cubic foot volume of the vibratory finishing apparatus.

4. The method of claim 1, wherein the non-abrasive plastic media has a hardness of about 57 on the Barcol scale.

5. The method of claim 1, wherein the non-abrasive plastic media comprises about 50% by weight alumina bonded with an unsaturated polyester resin.

6. The method of claim 1, wherein the non-abrasive plastic media has a density of about 1.8 g/cm3.

7. The method of claim 1, wherein the non-abrasive plastic media has a crystal size of less than 0.9 mm.

8. The method of claim 1, wherein the chemical solution comprises a chemical selected from the group consisting of phosphoric acid, phosphates, sulfamic acid, oxalic acid, oxalates, sulfuric acid, sulfates, chromic acid, chromates, bicarbonate, fatty acids, fatty acid salts, and combinations thereof.

9. The method of claim 8, wherein the chemical solution further comprises an activator or accelerator selected from the group consisting of zinc, magnesium, iron phosphates and combinations thereof.

10. The method of claim 8, wherein the chemical solution further comprises an oxidizer, selected from the group consisting of inorganic oxidizer, organic oxidizer, peroxides, meta-nitrobenzene, chlorate, chlorite, persulfates, nitrate, nitrite compounds, and combinations thereof.

11. The method of claim 8, wherein the chemical is provided as a concentrate, and is diluted with water to prepare the chemical solution, wherein the chemical is diluted to between 5–80% by volume of the solution.

12. The method of claim 1, wherein the metal article comprises steel.

13. The method of claim 12, wherein the chemical solution comprises phosphates.

14. The method of claim 13, wherein the chemical solution is introduced into the vibratory finishing apparatus at a rate of about 0.375 gallons per hour per cubic foot volume of the vibratory finishing apparatus.

15. The method of claim 1, wherein the non-abrasive plastic media is cone shaped.

16. The method of claim 1, wherein after the surface of the metal article has been refined, a burnishing solution is introduced into the vibratory finishing apparatus.

17. The method of claim 1 herein the metal article comprises brass.

18. The method of claim 17, wherein the chemical solution is comprises hydrogen peroxide and is maintained at a concentration at about 10% by volume.

19. The method of claim 18, wherein the chemical solution is introduced into the vibratory finishing apparatus at a rate of about 0.4 gallons per hour per cubic foot volume of the vibratory finishing apparatus.

20. The method of claim 1, wherein the rate of blackmode formation and removal is balanced so that the blackmode is soft enough to allow the non-abrasive plastic media to remove the blackmode from the surface of the metal article and finish the metal article to an Ra of less than or equal to 2.5 microinches.

21. A method for finishing a metal article, comprising the steps of:

a) placing the metal article in a vibratory finishing apparatus, in combination with:

i. a chemical solution capable of reacting with the surface of the metal article to form a blackmode on the surface of the metal article, and ii. a non-abrasive metal media that is not reactive with the chemical solution; and b) agitating the metal article, the non-abrasive metal media, and chemical solution in the vibratory finishing apparatus so as to allow the non-abrasive metal media to remove the blackmode from the surface of the metal article, thereby refining the surface of the metal article, after which the blackmode is immediately re-formed by the reaction between the metal article and the chemical solution for further refining by the non-abrasive metal media, until the metal article achieves a superfinished surface;

wherein the non-abrasive metal media that is not reactive with the chemical solution is combined with a non-abrasive plastic media.

22. The method of claim 21, wherein the non-abrasive metal media is selected from the group consisting of stainless steel media, titanium alloys, nickel-chromium alloys and combinations thereof.

23. The method of claim 21, wherein the vibratory finishing apparatus is operated at 800–1500 revolutions per minute at an amplitude of 1 to 8 millimeters.

24. The method of claim 21, wherein the chemical solution is added to the vibratory finishing apparatus at a rate of 0.25–0.4 gallons per hour per cubic foot volume of the vibratory finishing apparatus.

25. The method of claim 21, wherein the shape of the non-abrasive metal media is selected from the group consisting of pins, diagonals, ballcones, and mixtures thereof.

26. The method of claim 21, wherein the chemical solution comprises a chemical selected from the group consisting of phosphoric acid, phosphates, sulfamic acid, oxalic acid, oxalates, sulfuric acid, sulfates, chromic acid, chromates, bicarbonate, fatty acids, fatty acid salts, and combinations thereof.

27. The method of claim 26, wherein the chemical solution further comprises an activator or accelerator selected from the group consisting of zinc, magnesium, iron phosphates and combinations thereof.

28. The method of claim 26, wherein the chemical solution further comprises an oxidizer, selected from the group consisting of inorganic oxidizer, organic oxidizer, peroxides, meta-nitrobenzene, chlorate, chlorite, persulfates, nitrate, nitrite compounds, and combinations thereof.

29. The method of claim 26, wherein the chemical is provided as a concentrate, and is diluted with water to prepare the chemical solution, wherein the chemical is diluted to between 5–80% by volume of the solution.

30. The method of claim 21, wherein the metal article comprises steel.

31. The method of claim 30, wherein the chemical solution comprises oxalic acid.

32. The method of claim 30, wherein the chemical solution is introduced into the vibratory finishing apparatus at a rate of about 0.625 gallons per hour per cubic foot volume of the vibratory finishing apparatus.

33. The method of claim 21, wherein after the surface of the metal article has been refined, a burnishing solution is introduced into the vibratory finishing apparatus.

34. The method of claim 21, wherein the rate of blackmode formation and removal is balanced so that the blackmode is soft enough to allow the non-abrasive metal media to remove the blackmode from the surface of the metal article and finish the metal article to an Ra of less than or equal to 2.5 microinches.

* * * * *